United States Patent [19]

Ingermann et al.

[11] Patent Number: 4,959,884

[45] Date of Patent: Oct. 2, 1990

[54] COMBINATION BOWLING LANE STRIPPER AND DRESSING APPARATUS

[75] Inventors: Donald E. Ingermann, Arvada; Ronald L. Smith, Boulder; Stephen F. Caffrey, Arvada; Lonney J. Steinhoff, Evergreen, all of Colo.

[73] Assignee: Century International Corporation, Golden, Colo.

[21] Appl. No.: 509,243

[22] Filed: Apr. 16, 1990

Related U.S. Application Data

[63] Continuation-in-part of Ser. No. 371,295, Jun. 29, 1989, Pat. No. 4,920,604.

[51] Int. Cl.[5] ..... A47L 11/282

[52] U.S. Cl. ..... 15/302; 15/4; 15/98; 15/319

[58] Field of Search ..... 15/4, 98, 302, 319, 15/312 R, 320

[56] References Cited

U.S. PATENT DOCUMENTS

| | | | |
|---|---|---|---|
| 2,622,254 | 12/1952 | Mendelson | 15/320 X |
| 2,893,047 | 7/1959 | Swihart | 15/300 A X |
| 3,083,390 | 4/1963 | Wroten | 15/319 X |
| 3,216,036 | 11/1965 | Rockwood et al. | 15/319 X |
| 3,321,331 | 5/1967 | McNeely | 15/4 |
| 3,418,672 | 12/1968 | Regan | 15/4 X |
| 3,604,037 | 9/1971 | Varner | 15/4 |
| 3,729,769 | 5/1973 | Sharpless | 15/414 X |
| 3,787,916 | 1/1974 | Akagi et al. | 15/4 |
| 3,868,738 | 3/1975 | Horst et al. | 15/4 |
| 4,246,674 | 1/1981 | Ingermann et al. | 15/4 |
| 4,369,544 | 1/1983 | Parisi | 15/320 |

*Primary Examiner*—Chris K. Moore

*Attorney, Agent, or Firm*—Fields, Lewis, Pittenger & Rost

[57] ABSTRACT

In accordance with the present invention, a combination apparatus is provided wherein cleaner is applied to all or a portion of the lane and the cleaner, dressing and other residue is picked up by a vacuum head trailing the cleaner applicator followed by a buffer roller to apply new dressing to the lane. If desired, the cleaning operation can be limited to the last forty-five feet or so, since it is generally desirable to clean this portion of the lane more often than the front portion. On the return or reverse movement of the stripper, no cleaning operations are undertaken but cleaner may be permitted to flow from the cleaner storage tank to the applicator so that the applicator will have sufficient cleaner in it for the beginning of application on the next lane. In an alternative embodiment, the applicator may be in the form of a spray nozzle to spray cleaner onto the lane. A distance wheel is provided which supplies digital signals to a control apparatus which sequences each operation at the appropriate position of the carriage along the bowling alley.

12 Claims, 9 Drawing Sheets

FULL
BACK
VAC HD
OFF-ON
S/RUN
SOL PAD
BUFFER
OIL
F
R
OFF
F&R
VAC MOTOR
MAN. REV
MOTOR
FUSE
MAIN POWER

Fig_4
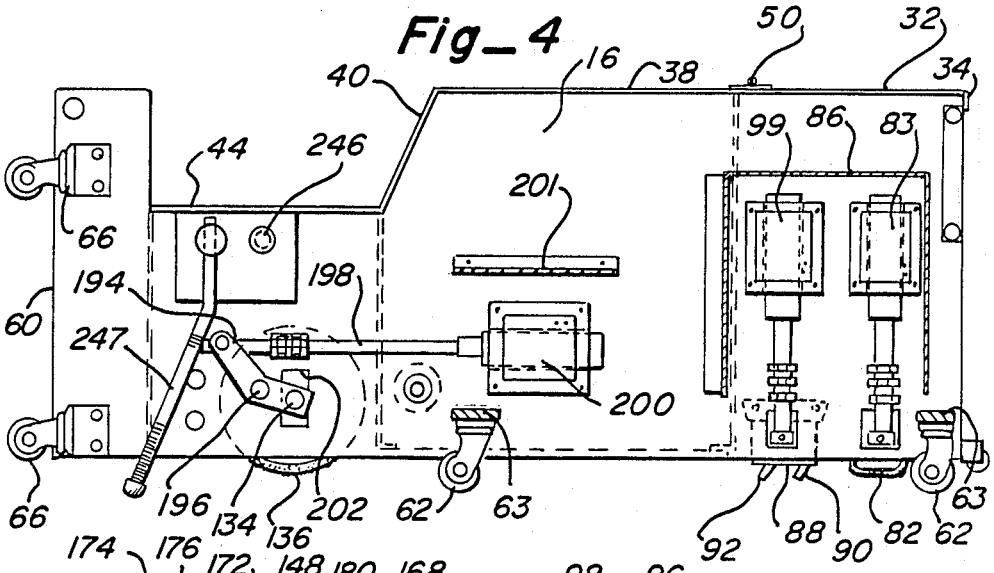
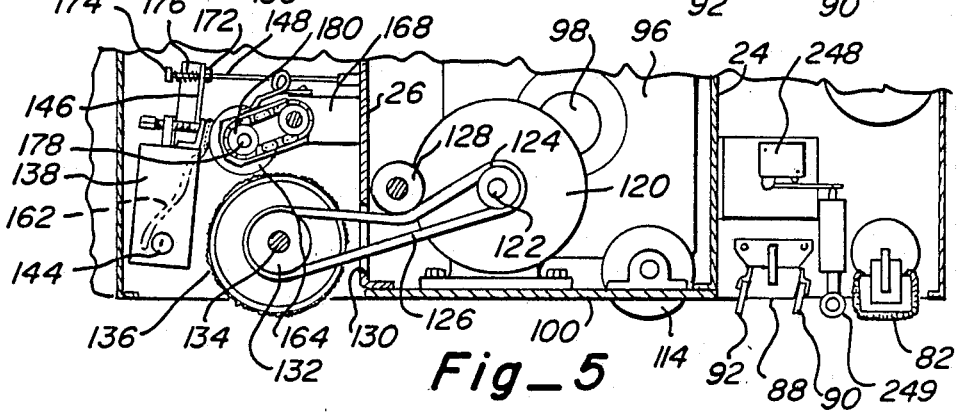
Fig_5
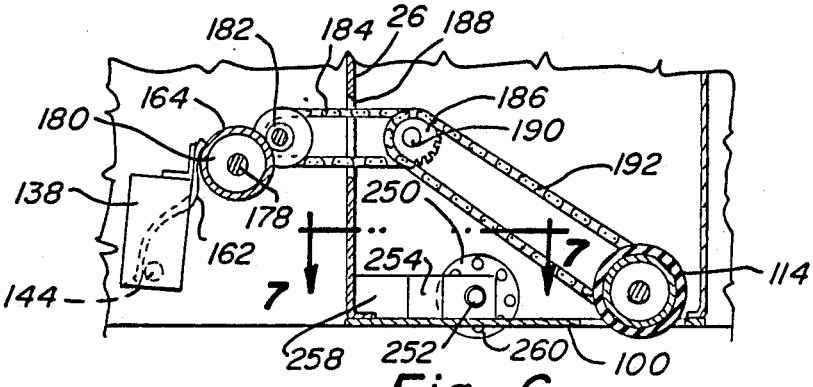
Fig_6

COMBINATION BOWLING LANE STRIPPER AND DRESSING APPARATUS

This application is a continuation-in-part application of our-co-ending U.S. Ser. No. 371,295, filed June 26, 1989, now U.S. Pat. No. 4,920,604, issued May 1, 1990 and entitled "Automatic Vacuum Bowling Lane Stripper".

TECHNICAL FIELD

This invention relates to a combination bowling lane stripper and dressing apparatus and more particularly to an automatic device wherein cleaner is applied to the dressing on the lane, the cleaner, old dressing and dirt are immediately vacuumed from the lane and removed and new dressing is applied in a single trip of the apparatus down the lane.

BACKGROUND ART

The closest and most pertinent prior art known is that which forms the subject matter of Varner U.S. Pat. No. 3,604,037 and Horst et al. U.S. Pat. No. 3,868,738 both of which are now owned by the assignee hereof. The first of these patented lane conditioning machines has proven to be very versatile and eminently satisfactory for performing a variety of necessary operations but is quite expensive due to its complexity. It includes buffers, applicators for applying both lane-dressings and cleaners, dusting mechanisms using moving cloth webs, lane position sensors and sophisticated cam actuated controls for initiating and terminating the various operations at precise positions along the lane. More specifically, the primary functions to be performed by the machine disclosed in the Varner patent were those of dressing the first forty-five feet of the lane with a thin coating of dressing and then stripping all dressing, dust and dirt from the remainder of the lane all the way back to the pin deck on a daily basis. This stripping operation utilized a rotating drum-type applicator to which the cleaner was applied as it turned. Since the amount of dressing on the remote end of the lane is basically only that which is carried there by the ball as it rolls from the dressed section toward the pins it is easily removed with a very small amount of cleaner. For this purpose, the cleaner applicator of the Varner patent proved to be quite satisfactory. However, it can not clean the much greater quantity of dirt and dressing from the dressed portion of the lane. There appeared to be several reasons for this, not the least of which was the inability of the rotating applicator to handle the accumulation of dirt and dressing so as to leave the lane stripped of all foreign matter. The roller itself could not hold enough cleaner to properly remove the dressing from the dressed section of the lane and, as a result, any applicator subassembly for use on this part of the lane would, of necessity, have to be redesigned.

In addition to the rotating cylindrical applicator, the cleaner reservoir and system of nozzles for wetting the applicator proved to be a source of trouble when attempts were made to adapt them to the volume of cleaner needed to strip the dressed section of the lane.

Another analogous, but nonetheless different, problem was that of picking up the suspension consisting of the insoluble particulate matter suspended in the cleaner with the dressing dissolved therein so as to leave the lane clean and ready to be dressed. In the Varner unit, small amounts of cleaner were sprayed onto a pad which rested atop the rotating applicator and transferred the cleaner thereto. Also engaging this applicator was a dust cloth which removed the dust from its surface. While provision was made for unrolling the dust cloth when the area thereof in contact with the applicator got dirty, no fresh dust removal surface was supplied on a continuous basis nor was one needed since the amount of dust picked up by the applicator on the undressed part of the lane was minimal. A continuously changing dust cloth was passed underneath a wiper pad at the opposite end of the unit but it was not intended, nor was it used, to clean cleaner and particulate matter from the wet applicator. The stationary dust cloth in contact with the applicator proved to be unsatisfactory in removing from the rotating applicator the vastly greater amount of cleaner it had to be supplied with in order to clean the dressed section of the lane.

The Horst et al. patent refers to the need for a lane-conditioning machine that is both less complicated and less expensive than the one forming the subject matter of the Varner patent. The latter unit differs materially from the former one in that it includes no provision for stripping dressing from the lanes. Instead, it only applies a dressing thereto, buffs and dusts the lane. Furthermore, none of the subassemblies present in the Horst et al. machine is any more satisfactory than those of the Varner patent for either stripping the dressing from the dressed areas of the lane or removing the residues left following such an operation. The net result as far as the bowling alley proprietor is concerned is that he or she must still manually strip the dressing from the dressed portions of the lane on a periodic basis, usually once a week. The Varner machine is effective on a daily basis to strip the dressing from the undressed sections of the lane and to re-dress the dressed section but not to strip it. The Horst et la. machine, on the other hand, is even more limited since it can only dress the lane and it includes no provision for stripping it whatsoever.

An automatic lane stripper machine disclosed in Ingermann et al. U.S. Pat. No. 4,246,674 was a much needed adjunct to assignee's existing pair of patented conditioning machines referred to previously. It includes the simple, yet unobvious, expedient of replacing the driven roller type applicator with a wettable pad that remains in contact with the lane surface during the excursion of the machine from the foul line to the pin deck. Cleaner is applied directly to this pad in amounts anywhere from about seven to over a hundred times that which the Varner unit is capable of handling using the wiping action by means of which cleaner is transferred from a wiper pad to the surface of the applicator roller. A moving web of absorbent material is used to not only dust the lane as in the previously-described machines but to continuously wipe the absorbent surface of the rotating pick-up roller and remove the solid and liquid residues therefrom before they can be returned to the surface of the lane. The dusting function of the moving web and the buffing function of the residue pick-up roller, while significant, are nonetheless subordinate to their main functions of removing all liquid and solid residues left over following the stripping operation from the surface of the lane since, in each instance, the lane will be re-dressed and buffed with other machinery or by hand before being used.

Other aspects of the Ingermann et al. stripper have to do with the way in which it is supported as it runs to and fro along the lane and its various operations controlled as a function of its location as determined by feelers and means responsive to the main carriage drive. More specifically, the applicator is charged with its supply of cleaner during portions of both its forward and return runs, the latter while it is raised up into its inoperative position thus giving the charge an opportunity to disburse evenly along the pad before becoming operative again. Some of these same feelers sense the position of the unit so as to reverse its direction of movement, deactuate the applicator while re-activating the cleaner supply mechanism in a manner to charge the latter with cleaner and terminate the stripping cycle as the unit returns to the foul line.

Finally, the rotating pick-up roller further removes any remaining debris or liquid cleaner from the bowling lane and the moving web follows along therebehind to provide a final wiping function. Thus, the Ingermann et al. stripper preforms cleaning functions during both the forward and reverse movement of the apparatus along the lane.

Our above-mentioned co-pending U.S. patent application Ser. No. 371,295 discloses an apparatus wherein cleaner is applied to all or a portion of the lane and the cleaner, dressing and other residue is picked up by a vacuum head trailing the cleaner applicator in one trip from the foul line to the pit leaving the lane clean and dry. If desired, the cleaning operation can be limited to the last thirty-six feet or so, since it is generally desirable to clean this portion of the lane more often than the front portion. On the return or reverse movement of the apparatus, no cleaning operations are undertaken but cleaner may be permitted to flow from the cleaner storage tank to the applicator so that the applicator will have sufficient cleaner in it for the beginning of application on the next lane. Means is provided for bowing the vacuum head so that the center is lower than the ends to conform generally to the concave shape of a bowling alley. A waste tank is provided with appropriate baffles to separate the waste liquid and solids from an air stream created by a vacuum motor attached to the outlet of the waste tank.

DISCLOSURE OF THE INVENTION

In accordance with this invention, a combination bowling lane stripper and dressing apparatus has been provided. This apparatus includes a carriage for movement along the bowling alley from the foul line to the pit and back again. A reversible drive mechanism is connected to the carriage and has a drive shaft and surface-engaging drive wheels mounted on the drive shaft operative to advance the carriage along a predetermined course in a forward and reverse direction. A cleaner applicator means extends transversely of the carriage in a forward portion thereof. A cleaner reservoir is provided and has means for supplying cleaner to the applicator. A fluid valve controls flow of fluid from the reservoir to the applicator. The device also includes a vacuum means having a vacuum head extending transversely of the carriage rearwardly of the applicator means and mounted for movement with respect to the carriage between an operative lane-engaging position and a retracted position within the carriage and above the lane. The carriage has lane-buffing means in the rear section thereof which includes a roller and a drive means. The roller is journalled for rotation with its surface in lane-contacting relationship about an horizontal axis extending transversely of the direction of travel. A lane-dressing means is detachably connected to the lane-buffing roller and includes a reservoir for the storage of lane dressing fluid. A fluid transfer means is selectively operative to transfer fluid from the reservoir to the surface of the lane-buffing roller. There is also a power supply means in the carriage and control means connected to the power supply means responsive to control signals to selectively activate and deactivate each function of the stripper. There is an on-off switch which can be closed for activating the drive mechanism so that the carriage travels in a forward direction from the foul lane to the pit. The first means is responsive to the control means for opening the fluid valve during at least a portion of the forward travel. A second means is responsive to the control means for moving the vacuum head into lane engaging position. A third means is responsive to the control means for causing the fluid transfer means to be operative to transfer dressing fluid from the reservoir to the surface of the lane-buffing roller. A fourth means is responsive to the control means to cause the fluid transfer means to become inoperative and a fifth means is responsive to the control means for deactivating the first and second responsive means to shut-off the fluid valve. A limit switch is responsive to the carriage reaching the pit to cause the control means to deactivate the drive mechanism to stop the carriage and deactivate the second responsive means to raise the vacuum head to retracted position.

In one form the invention the cleaning applicator comprises a pad which moves into an operative position in engagement with the lane. In another embodiment, the cleaner applicator is a sprayer which sprays cleaner onto the lane ahead of the carriage. The sprayer has a motor-driven pump connected between the reservoir and the sprayer for pumping cleaner under pressure through the sprayer. Conveniently, the sprayer may include a pair of spray heads mounted on the forward end of the carriage and a plurality of nozzles attached to each head.

The fluid transfer means for the lane dressing can include a transfer roller which is in contact with the buffing roller to transfer dressing fluid to the buffing roller. A wick is provided which has a first end in the lane dressing fluid container and a second end positioned to be brought into engagement with the transfer roller and has a width extending substantially the entire length of the transfer roller. A means is provided for selectively pressing the second end of the wick against the transfer roller. A plurality of fingers along the pressing means are selectively biased to apply different pressures to the wick to selectively control the amount of dressing fluid applied along the transfer roller and the dressing roller to control the amount of dressing applied to each lateral increment of the bowling alley. More specifically, the pressing means includes a lateral bar mounted in generally parallel relation to the transfer roller. A plurality of adjustment screws are laterally spaced along the bar and each screw has an end bearing against one of the fingers and is threadably mounted on the bar for adjusting the pressure applied to each finger by each screw.

The control means of this device can include a measuring wheel engageable with the bowling lane and having a circumference equal to a known linear distance so that each revolution of the measuring wheel represents the known linear distance. Indicia is spaced equal distances around the circumference of the measuring wheel to identify incremental movement of the measuring wheel. Means is provided for sensing the position of the indicia as the wheel rolls along the bowling alley to provide the control signals.

Each indicia can be an opening through the measuring wheel. In such an embodiment, the sensing means includes a light source mounted on one side of the measuring wheel and positioned to be aligned with the openings sequentially as the measuring wheel turns to project a light beam therethrough. Means is mounted on the other side of the measuring wheel and positioned to sense the light beam sequentially as light pulses when the openings selectively become aligned with the light beam to produce the control signals.

Additional advantages of this invention will become apparent from the description which follows, taken in conjunction with the accompanying drawings.

BRIEF DESCRIPTION OF THE DRAWINGS

FIG. 4 is an enlarged horizontal section, taken along line 4—4 of FIG. 2, showing some of the control mechanisms;

FIG. 5 is an enlarged horizontal section, taken along line 5—5 of FIG. 2, showing the buffer roller;

FIG. 6 is an enlarged horizontal section, taken along line 6—6 of FIG. 2, showing details of the drive mechanism for the dressing roller;

BEST MODE FOR CARRYING OUT THE INVENTION

Figure 1:
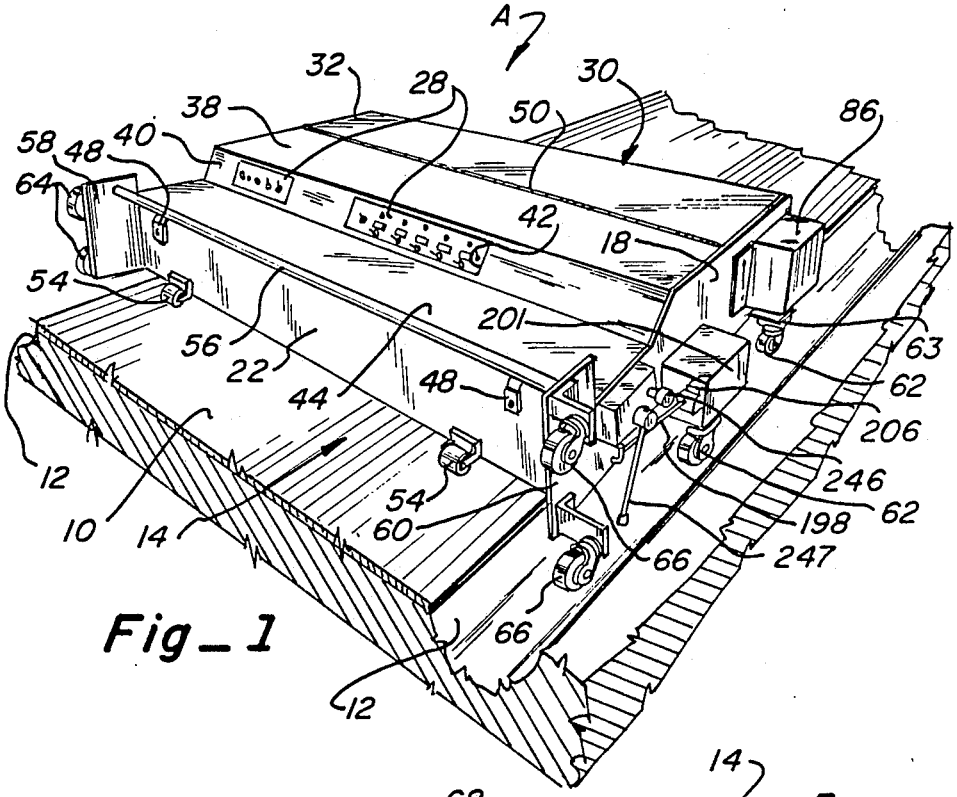
FIG. 1 is a perspective view of the combination lane stripper and dressing apparatus, constructed in accordance with this invention, in operative position on a bowling lane.

In accordance with the present invention, a combination bowling lane stripper and dressing apparatus A is provided which can be mounted for travel along a bowling lane 10 which has conventional gutters 12 on either side. Apparatus A has a carriage 14 which houses all of the functional elements of the apparatus. The carriage includes opposite side walls 16 and 18 interconnected by a front wall 20 and a back wall 22.

Figures 3, 3A:
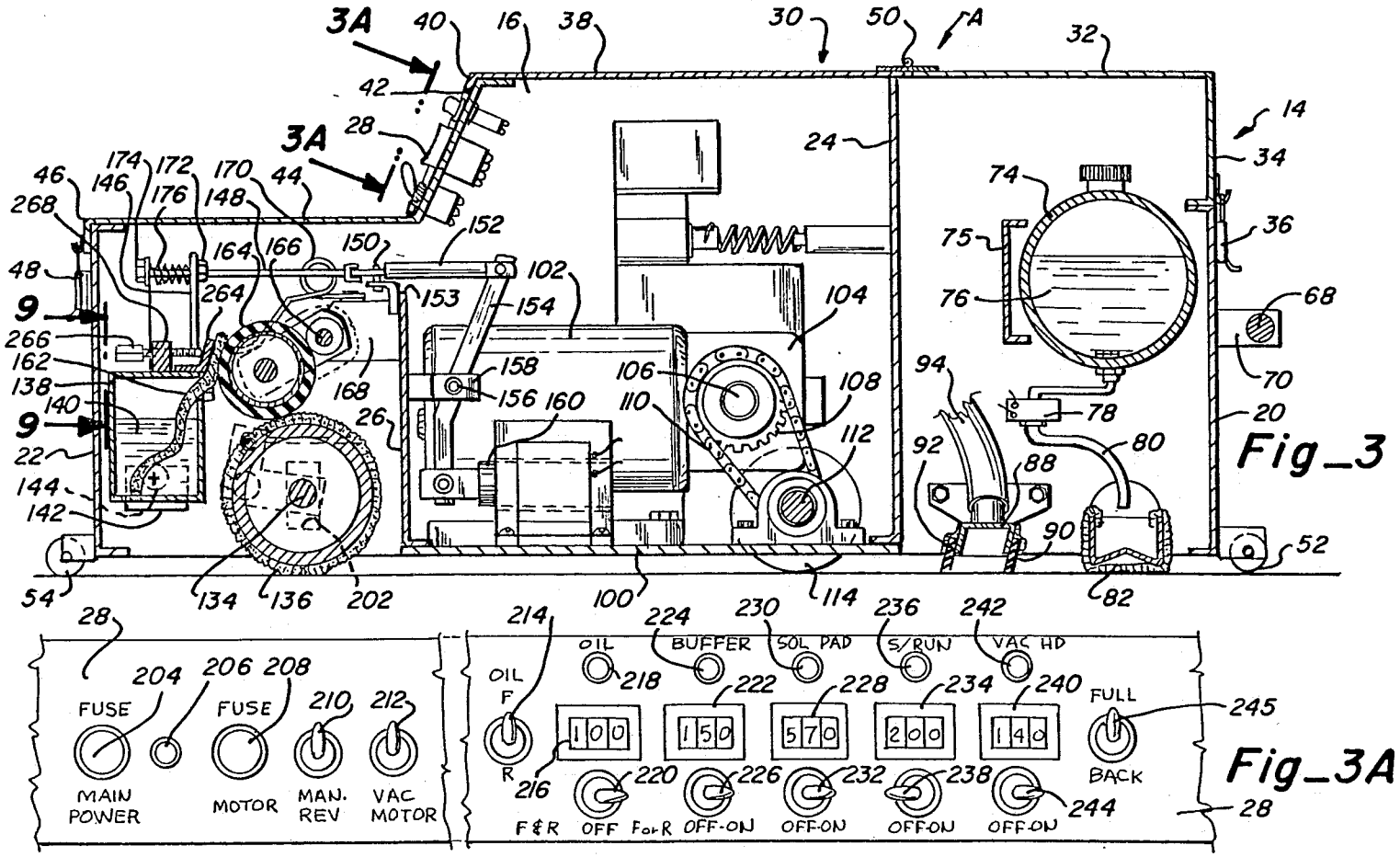
FIG. 3 is an offset vertical section, taken along line 3—3 of FIG. 2, showing details of the components contained within the forward, central and rear sections of the carriage.
FIG. 3A is an enlarged, fragmentary view of the control panel for the apparatus.

As best seen in FIG. 3, the carriage 14 is divided into compartments or sections by a forward transverse wall 24 and a rear transverse wall 26. The section forwardly of wall 24 contains the solvent or cleaner applying apparatus. The central section of the carriage between walls 24 and 26 contains the drive mechanism and controls for operation of the carriage. The rear section between rear transverse wall 26 and rear wall 22 contains the dressing mechanism for applying new dressing to the bowling lane surface. Extending upwardly and forwardly from the upper end of rear transverse wall 26 is a control panel 28 on which many of the controls and function lights for operating the carriage are mounted.

Conveniently, a hinged cover 30 is provided which includes a forward portion 32 which extends over the cleaner dispensing apparatus and has a depending lip 34 which can be releasibly connected to front wall 20, as by latches 36. Cover 30 also has a rearwardly extending horizontal portion 38 terminating in depending section 40 which has an opening 42 through which control panel 28 may be viewed. The depending end of section 40 terminates in a horizontal rear panel 44 having a depending lip 46 which is releasibly connectable to rear wall 22 by latches 48. Advantageously, forward portion 32 and 38 are interconnected, as by hinge 50 so that either the forward portion or the rear portion may be raised for inspection and/or service of the respective portions of the apparatus within the carriage.

The carriage 14 is supported for movement along the bowling lane surface by a pair of spaced front rollers 52 and a pair of spaced rear rollers 54. Above the rear rollers 54, as shown in FIG. 1, is a transverse bar 56 which is supported in brackets 58 and 60 attached, respectively, to sidewalls 16 and 18 as shown. The bar can be used to lift the rear end of the apparatus A to align it properly on the bowling alley surface. Another pair of wheels 62 is attached to spaced brackets 63 on each of sidewalls 16 and 18, respectively, and extend out over gutters 12 to support the carriage when it moves across the foul line and up onto the approach. Mounted on brackets 58 and 60, respectively, are pairs of casters 64 and 66 for supporting the apparatus when it is raised to an upright position by means of handle 56 and a front handle 68 attached to front wall 20 by brackets 70. In the upright position, the carriage 14 can be wheeled from a storage location to an alley or from one alley to the next.

Figure 2:
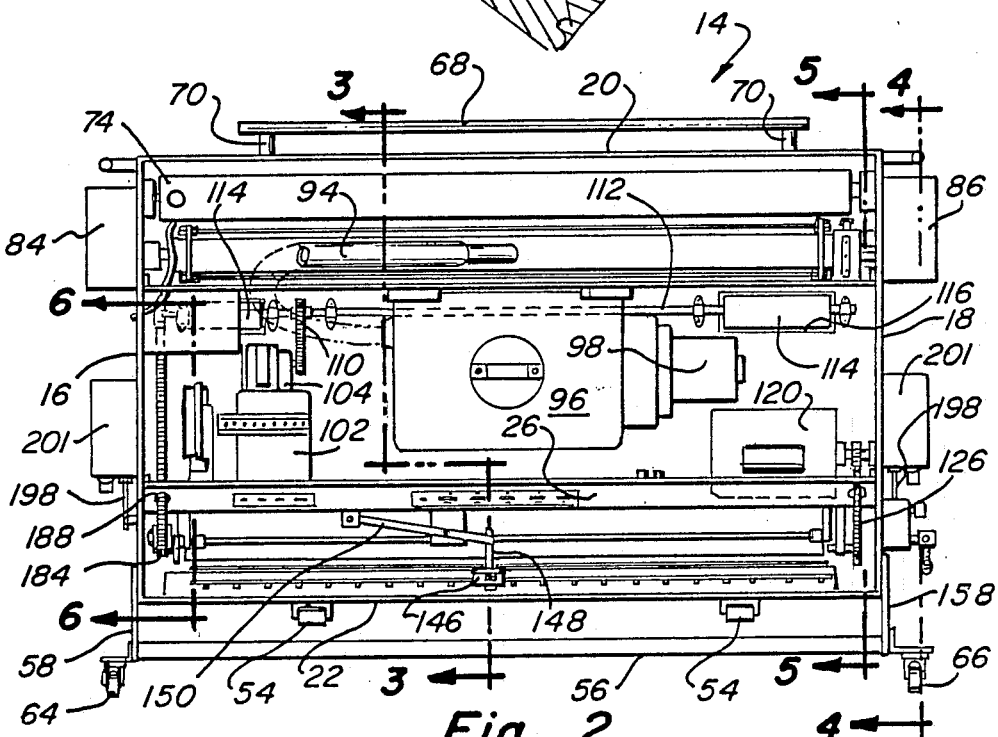
FIG. 2 is a top plan view of the lane stripper of FIG. 1, with the top cover removed.

As best seen in FIGS. 2 and 3, the front portion of the carriage is provided with a container 74, supported by a bracket 75, for containing a cleaner or solvent 76 which is dispensed by a control valve 78 and through a conduit 80 to a pad 82. A more complete disclosure and description of this apparatus can be found in our above-identified co-pending U.S. application Ser. No. 371,295 filed June 26, 1989. The pad is mounted for reciprocal movement by solenoids 83 mounted within housings 84 and 86, shown in FIGS. 2 and 4. The dispensed solvent will dissolve the dressing on the lane and suspend dust and other foreign matter which has accumulated thereon for pick-up by vacuum head 88 having a front and rear squeegees 90 and 92, as shown. The vacuum head is connected by means by a vacuum hose 94 to a waste container 96 through which a vacuum is drawn by vacuum motor 98 attached to the opposite side thereof, as shown in FIG. 2. The vacuum head is mounted for movement toward and away from the bowling lane surface by solenoids 99 also located within housings 84 and 86. The operation of the vacuum head is more fully disclosed in our above-identified pending U.S. application Ser. No. 371,295, whose subject matter is hereby incorporated by reference.

The vertical walls 24 and 26 which form the central compartment, are interconnected by a bottom wall 100 on which drive motor 102 is mounted. The motor is connected through a gear box 104 having a shaft 106 on which a sprocket 108 is mounted. A drive chain 110 extends around the sprocket and connects to shaft 112 having a pair of spaced drive rollers 114 mounted thereon. These drive rollers extend through openings 116 in bottom wall 100.

Also located within the central section is a buffer motor 120 with has a drive shaft 122 supporting a pulley 124 for rotation. A belt 126 extends around the pulley and passes under an idler roller 128 and through an opening 130 in vertical wall 26 and around a pulley 132 on shaft 134 of buffer roller 136. Thus, buffer motor 120 will cause the buffer roller 136 to be rotated to apply dressing to the surface of the bowling alley, as more fully described below.

In the rear compartment and to the rear of buffer roller 136 is a tank 138 for containing a liquid dressing 140. This tank is mounted on a bracket 142 at each end which supports it for rotation about pivot pin 144, as best seen in FIG. 4. Attached to the upper end of tank 138 is an L-shaped bracket 146 having a central opening through which a rod 148 extends. The rod is connected through a linkage 150 to an arm 152 which extends forwardly through an opening 153 in wall 26 and is pivotally attached to a lever 154. Lever 154 is pivoted intermediate its ends about a pivot pin 156 mounted in a bracket 158 mounted on vertical wall 26. The other end of lever 154 is connected to a solenoid 160. Thus, upon activation of the solenoid, the top of the tank 138 will be pulled forwardly so as to rotate about pivot pin 144 to bring the upper end of a wick 162 into contact with transfer roller 164 so that dressing will be transferred to buffing roller 136. Conveniently, the transfer roller 164 is pivotally mounted about a pin 166 mounted in a bracket 168 attached to vertical wall 26. A spring 170 urges the transfer roller 164 against buffer roller 136. The position of tank 138 when it is pivoted forwardly can be adjusted by means of nut 172 which is threadably mounted on rod 148 so that it can adjustably positioned. The end of rod 180 has a second nut 174 with a spring 176 between the nuts to provide suitable tension.

As best seen in FIG. 6, the transfer roller 164 is mounted for rotation about a shaft 178 which has a sprocket 180 in engagement with a sprocket 182 connected by a chain 184 to a third sprocket 186. Chain 184 extends through an opening 188 in vertical wall 26. Sprocket 186 is mounted on a shaft 190 and has a belt 192 extending to drive roller 114. Thus, the rotation of drive roller 114 will cause transfer roller 164 to be rotated to transfer dressing from wick 162 to buffing roller 136.

Referring to FIG. 4, it can be seen that means have been provided for selectively bringing buffing roller 136 into engagement with the bowling lane. In this regard, shaft 134 is mounted in a bracket 194 which is pivoted intermediate its ends about pivot pin 196. The other end of bracket of 194 is pivotally connected to a push rod 198 which is connected to a solenoid 200 mounted in housing 201. Thus, upon activation of the solenoid, the push rod will be moved to the left, as viewed in FIG. 4, causing bracket 194 to pivot in a counter clockwise direction so that shaft 134 moves upwardly in a slot 202 in sidewall 18. Upon deactivation of the solenoid, the buffing roller 136 will be lowered against the bowling lane surface.

As previously mentioned, a control panel 28 is provided, as best seen in FIG. 3A. Briefly described, from left to right, the control panel has a main power fuse 204, next to which is light 206, such as an LED or a neon bulb which indicates when the main power supply is turned on. Next to this is a motor fuse 208. To the right of this fuse is a manual reverse switch 210 which can be switched from its off position to its on position to cause the apparatus to move in the reverse direction along the alley. This switch is normally used only during set-up and/or adjustment of the device, but would normally remain in the off position during normal operation of the apparatus. Next to the manual reverse switch is a vacuum motor switch 212 which turns the vacuum motor on. This vacuum motor switch normally remains on during the entire operation of the device. Next is an oil dressing direction switch 214 which causes the dressing to be applied either in the forward or the reverse direction. For most usages of the apparatus the switch will be its upper position so that dressing is applied when the device moves in a forward direction from the foul line to the pit.

To the right of dressing direction switch 214 are a series of digital controls and switches for selecting the distance from the foul line toward the pit at which each operation is to commence. The numbers indicated on the digital switches are typical distances at which the various functions may begin to operate. However, it will be understood that each switch has three selector elements. The element on the right can be rotated to select one-tenth foot increments; the center element is used to select one foot units: and the left element is for selecting tens of feet. For example, digital control 216 can be set, at a desired distance, such as 10.0 feet at which point solenoid 160, shown in FIG. 3 will be activated to bring the end of wick 162 into contact with transfer roller 164 and begin the transfer of dressing to buffer roller 136. A light 218 is provided above the control element show when three position switch 220 is on. Switch 220 can be moved from the center off position to the left so that dressing is applied in both the forward and reverse directions or to the right-hand side so that it is applied only in the forward or reverse position, depending on the position of switch 214. A digital buffer control 222 is provided which can be set for a distance at which the buffer roller will be lowered against the bowling lane by activation of solenoid 200, shown in FIG. 4. As illustrated, this control has been set for 15.0 feet. A buffer light 224 and an on-off switch 226, which will normally be in the on position, are provided A solvent pad digital control 228 is provided which has a light 230 and an on-off switch 232. This digital control can be set at an appropriate distance, such as 57.0 feet at which solenoid pad 82 will be lowered by activation by solenoids 83 to bring the pad into engagement with the bowling lane. Next is a solvent digital control 234 for setting a distance, such as 20.0 feet, at which solenoid 78 will be activated to cause solvent 76 to flow from tank 74 to pad 82. A light 236 and an on-off switch 238 also is provided. A vacuum head digital control 240 also is provided, which may be set for a distance such as 14.0 feet, the distance at which solenoids 89 are activated to lower the vacuum head 88 against the bowling lane. This switch is also provided with a light 242 and an on-off switch 244. Finally, a switch 245 is provided for setting the machine for performing its functions for the full length of the bowling lane or only for the back portion. Sometimes it is only necessary to clean the back portion of the alley, which is nearest the pit while the front portion of the alley can be left untreated. In other words, the back portion of the alley must be stripped and dressed more often than the forward portion.

In addition to these switches, there is a start switch 246 on the side of the apparatus, as best seen in FIG. 4. Also, on this side of the machine there is a trip arm 247 which is rotated by the apron of the bowling alley during the return travel of the apparatus as it moves up out of the gutters to shut the apparatus down. As best seen in FIG. 5, a microswitch 248 is provided which is actuated by a spring loaded lane sensing roller 249. Thus, when the lane sensing roller 249 runs off the back of the alley into the pit, it will open switch 248 thereby shutting down the apparatus and causing it to go into its reversing mode to move back up the alley.

Figure 7:
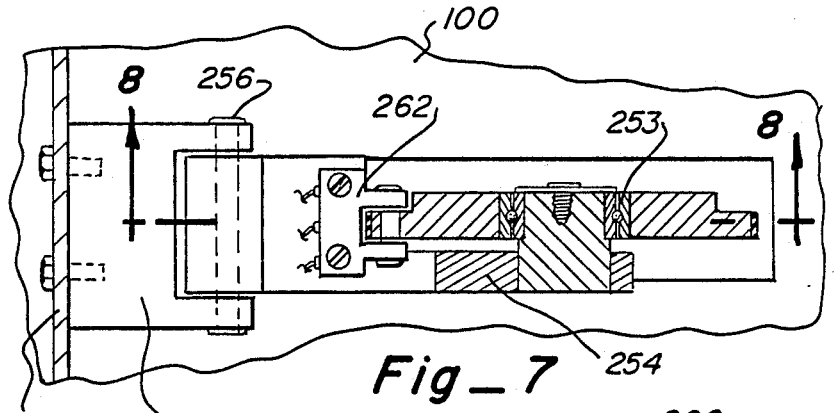
FIG. 7 is a fragmentary enlarged plan view, taken along line 7—7 of FIG. 6, showing the measuring wheel and sensor for the apparatus.
Figure 8:
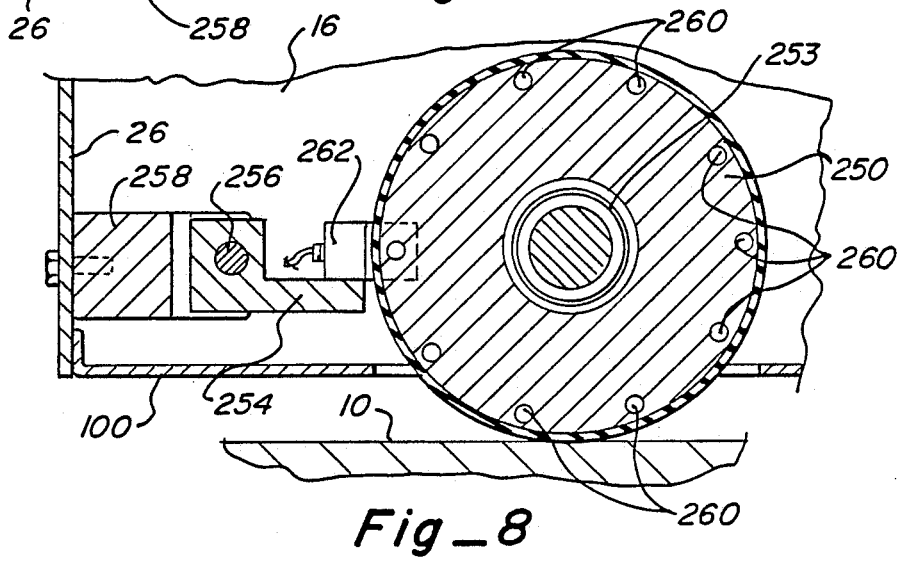
FIG. 8 is a vertical section, taken along line 8—8 of FIG. 7, showing further details of the measuring wheel and sensing device.
Figure 9:
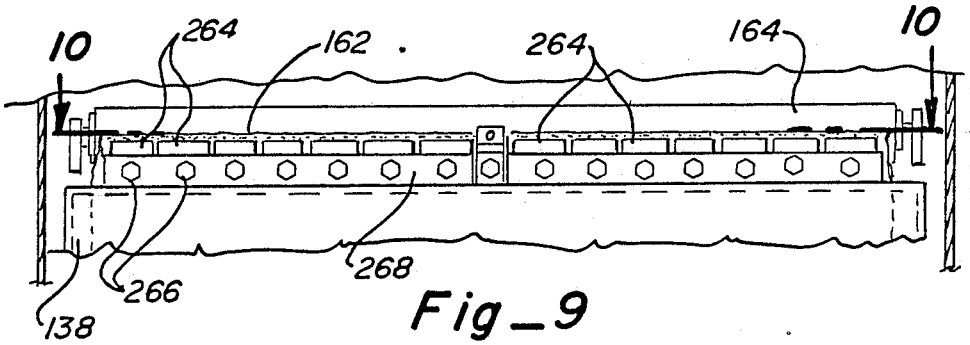
FIG. 9 is a vertical section, taken along line 9—9 of FIG. 3, showing a device for selectively applying pressure to the wick at incremental positions along its length.
Figure 10:
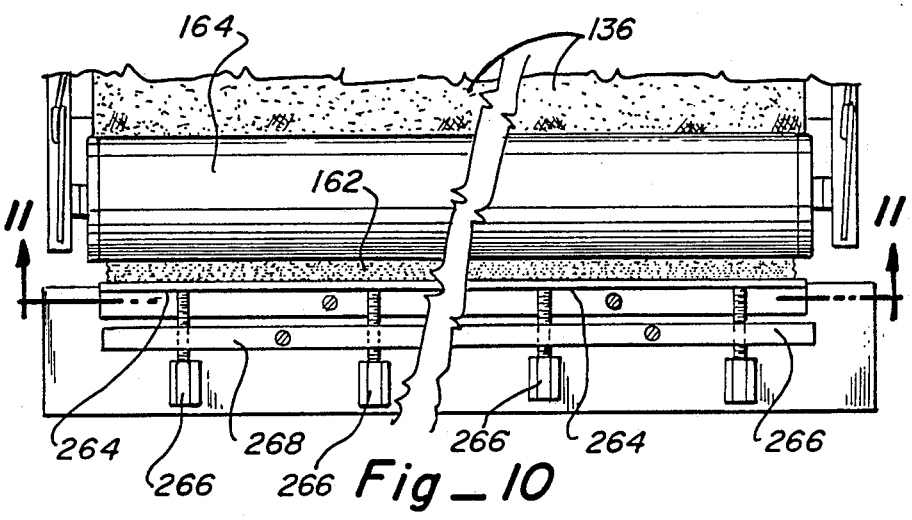
FIG. 10 is a fragmentary plan view, taken along line 10—10 of FIG. 9, showing additional details of the pressure applying means.

To measure the distance that the apparatus moves along the bowling lane, a measuring wheel 250 is provided which is exactly one foot in circumference. The measuring wheel is best seen by referring to FIGS. 6–8. It is mounted for rotation about a shaft 252 extending through bearings 253. Shaft 252 is mounted on a support 254 which is pivotally mounted on a pivot pin 256 in bracket 258 attached to wall 26, as shown. This arrangement assures that the measuring wheel does not slide or slip on the surface of bowling alley 10 as it rolls across any irregularities thereon. Around the periphery of measuring wheel 250 are transverse openings 260 which are spaced exactly one-tenth of a foot apart. A light sensing unit 262 is provided which has light emitting diode or other light source positioned on one side of the wheel and a light receiving receiver position on the other side of the wheel so that each time one of the openings 260 becomes aligned with the light sensing device 262 it will provide an electrical output pulse each time the wheel rotates one-tenth of a foot. Thus, very accurate measurements of the position and movement of apparatus A down the bowling alley can be provided.

When the dressing is applied to the lane, it must meet American Bowling Congress specifications which requires that the dressing be distributed from gutter to gutter for a predetermined distance down the lane and that there may be more dressing toward the center of the lane provided it increases and decreases in a smooth curve from edge to edge by a differential from board to board which does not exceed predetermined limits. The present invention provides precise control means for assuring that the application of the dressing to the lane is distributed in accordance with American Bowling Congress specifications. This apparatus is best illustrated in FIGS. 9–12. A plurality of fingers 264 are spaced laterally across wick 162. Pressure is applied to each finger by a screw 266, each of which is threadably received in a lateral bar 268 for selectively pressure adjustment. Conveniently, the fingers are formed as one side of an L-shaped member attached to the top of dressing tank 138, as best shown in FIG. 12.

Figure 11:
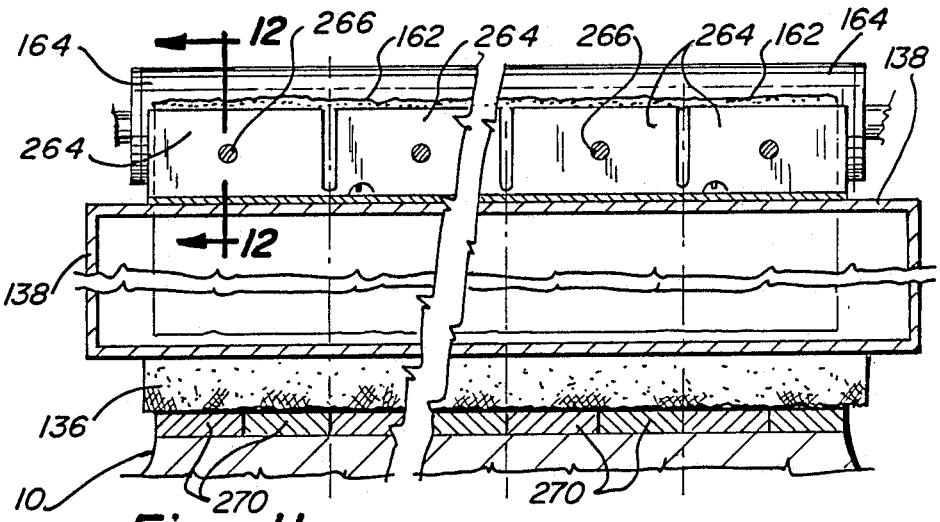
FIG. 11 is a vertical section, taken along line 11—11 of FIG. 10, showing the manner in which incremental amounts of dressing are applied to incremental portions of the bowling lane.
Figure 12:
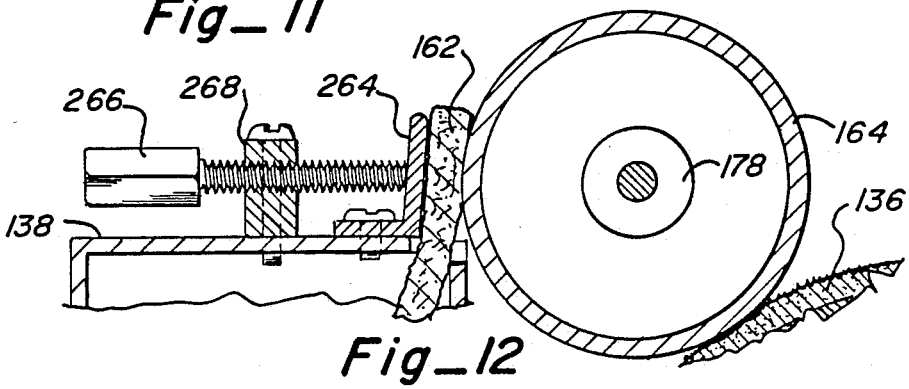
FIG. 12 is a vertical section, taken along line 12—12 of FIG. 11, showing further details of the pressure means.

As best seen in FIG. 11, each finger 264 is approximately the width of two boards 270 so that a precise amount of dressing can be applied to every two boards. Obviously, each finger could be made half as wide so that an adjustment could be provided for each board width. However, for most purposes a different adjustment for every two boards is sufficient. Also, the fingers could be made wider to accommodate more than two boards if this would provide adequate variation in the amount of dressing applied to the boards to conform to American Bowling Congress standards.

Figure 13:
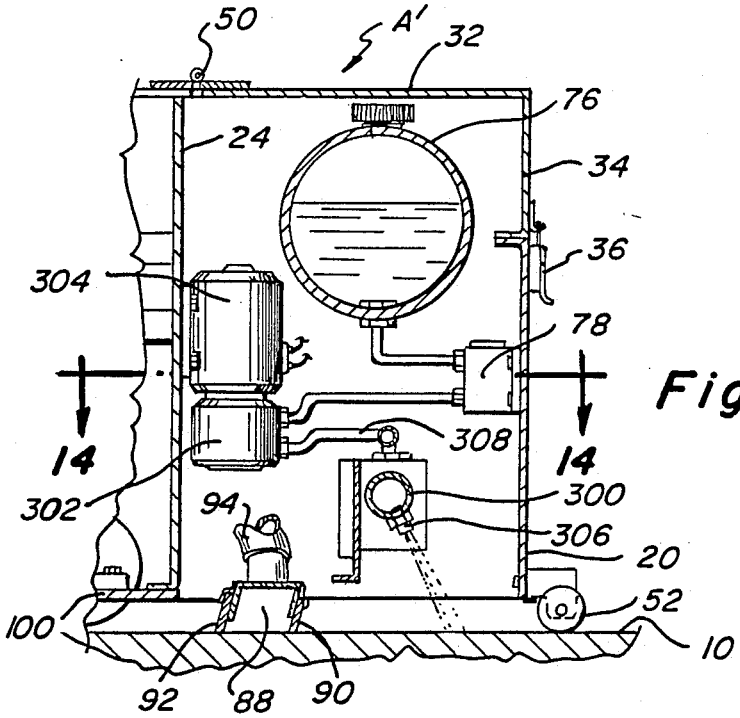
FIG. 13 is a vertical section of the forward portion of an alternative apparatus having a sprayer.
Figure 14:
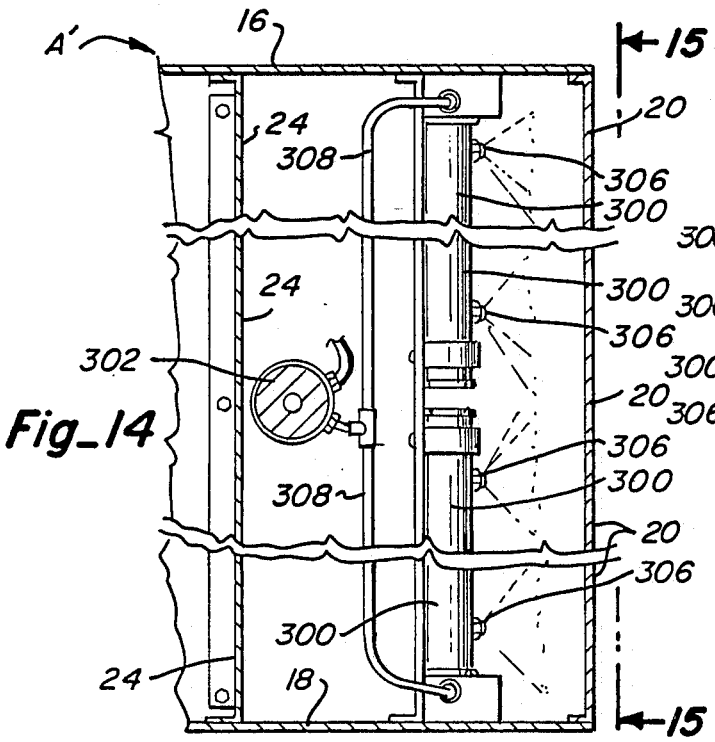
FIG. 14 is a fragmentary horizontal section, taken along line 14—14 of FIG. 13 showing further details of the sprayer arrangement.
Figure 15:
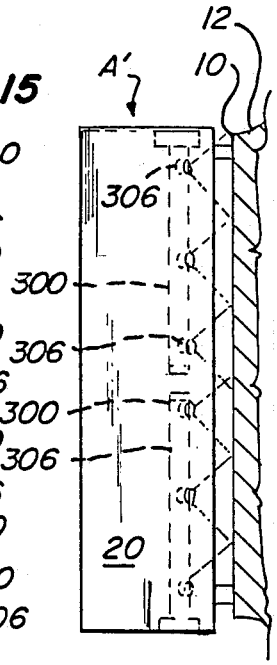
FIG. 15 is a front elevation, taken along line 15—15 of FIG. 14, on a reduced scale, showing further details of the sprayer.

In an alternative form of this invention, shown in FIGS. 13–15, an apparatus A' is provided wherein the applicator pad is replaced by a pair of laterally spaced sprayer heads 300. In this embodiment, the solvent 76 is provided through a solenoid 78 to a pump 302 which is driven by motor 304. The solvent is discharged through sprayer nozzles 306. Conveniently, pump 302 is connected to the sprayer heads 300 by a pair of conduits 308, as shown. Thus, cleaner can be applied to the bowling alley surface to emulsify the dressing and suspend any solid particles on the lane.

With this embodiment, it will be unnecessary to have the solvent pad digital control 228, its light 230 or on-off switch 232. Instead, solvent digital control 234 will control the operation of motor 304 rather than the operation of applicator solenoids 83.

Figure 16:
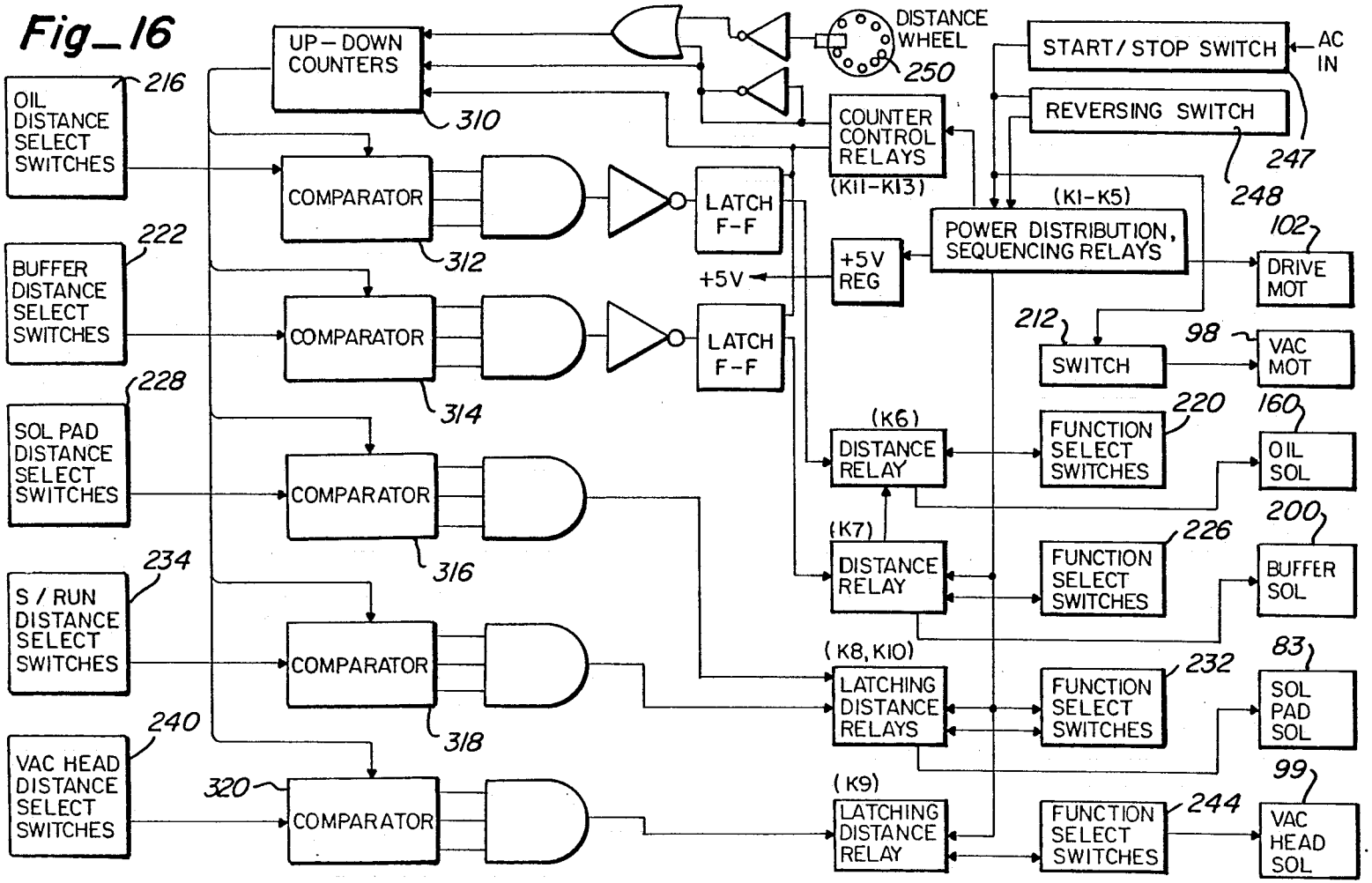
FIG. 16 is a block diagram of the circuitry and controls used with the apparatus of this invention.
Figure 17A:
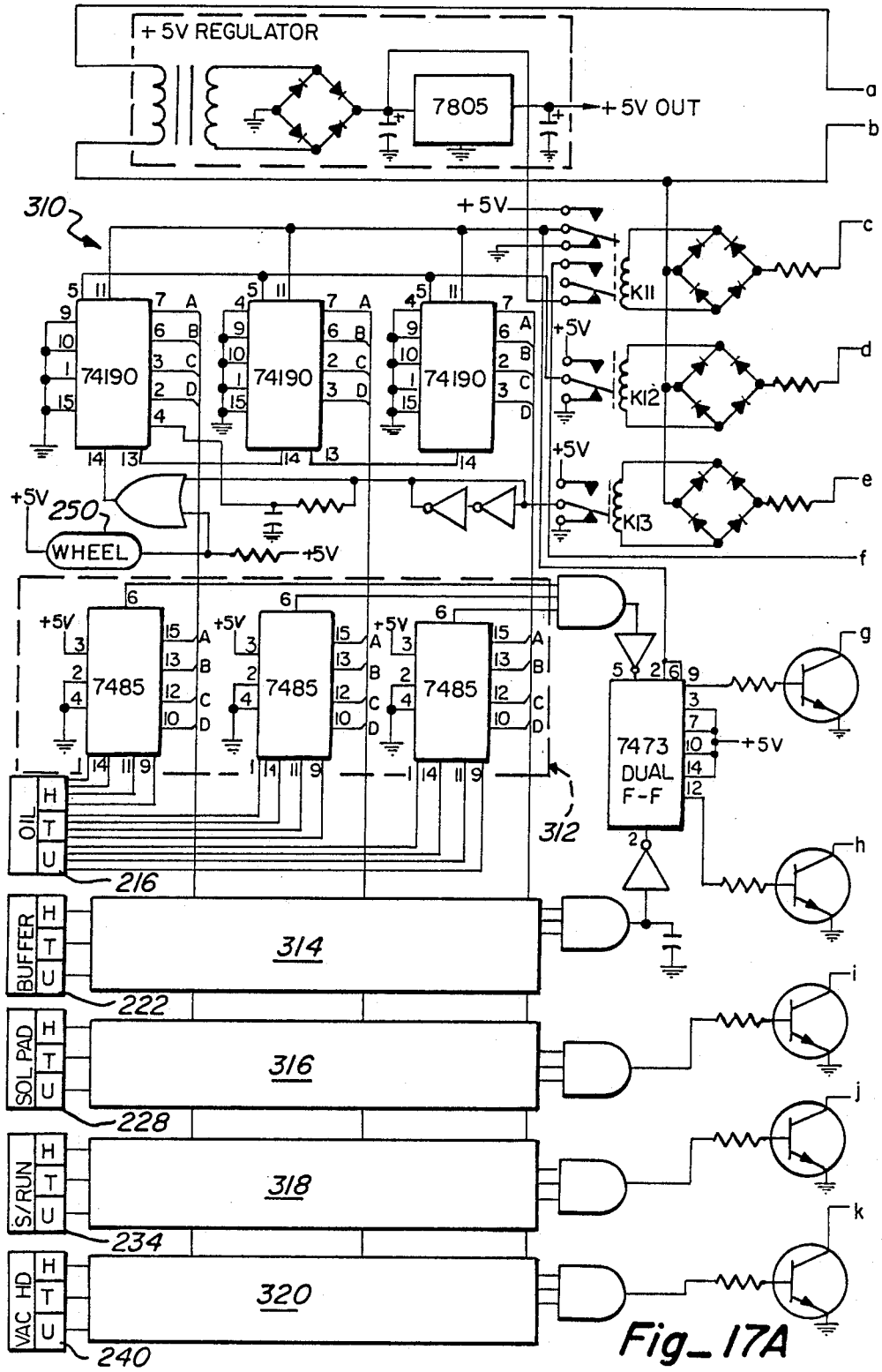
FIG. 17A is a detailed drawing of a portion of the circuitry of the apparatus of this invention.
Figure 17B:
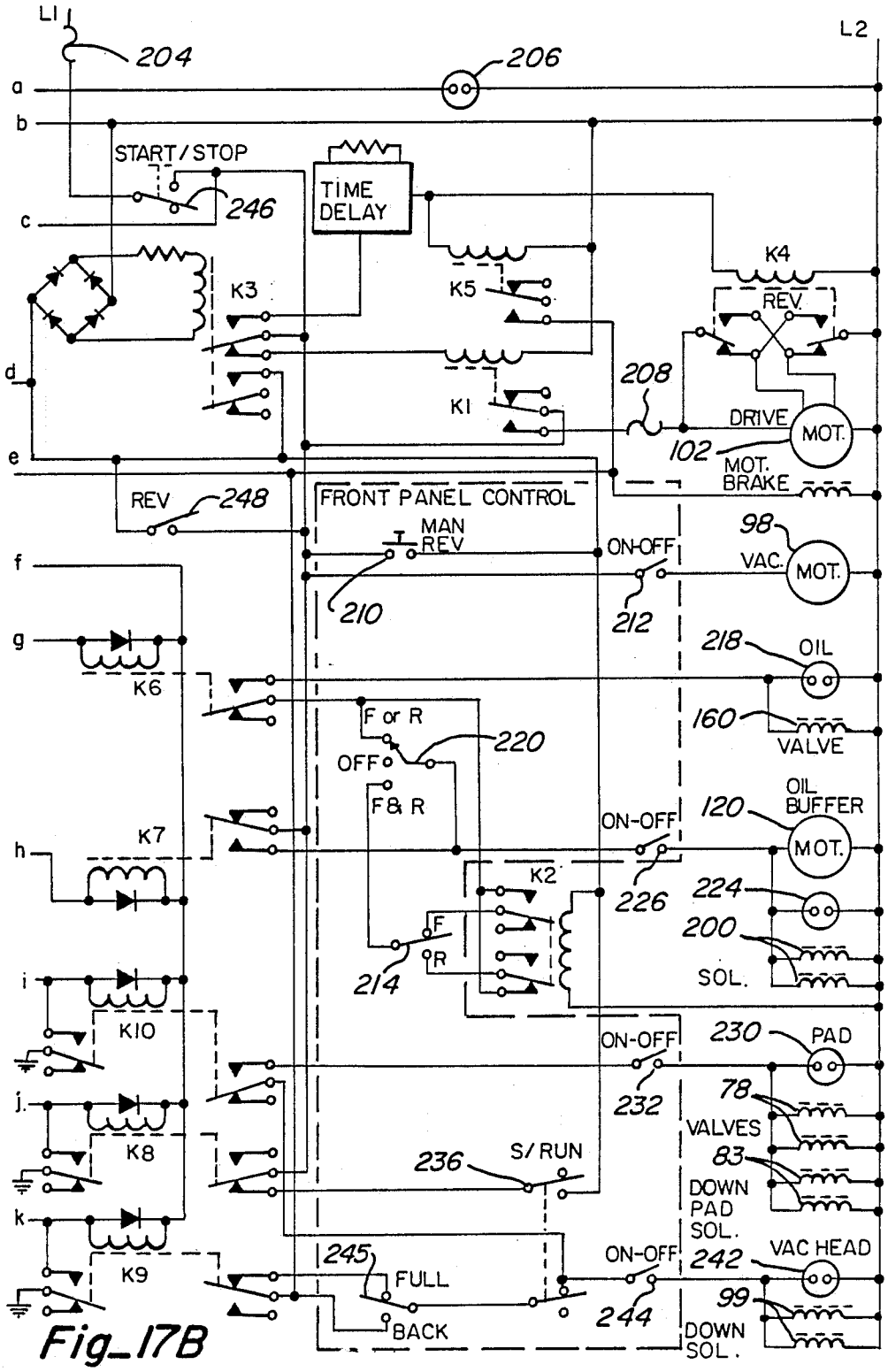
FIG. 17B is a detailed drawing of the remaining circuitry for the apparatus of this invention.

Circuitry for the first embodiment is illustrated in the block diagram shown in FIG. 16. The signals generated by distance wheel 250 as it is rotated will be supplied to up-down counters 310. The signal from the up-down counters 310 is supplied to a series of comparators corresponding to the various select switches. As shown, oil distance select switches 216 are connected to a comparator 312 whereas buffer distance select switches 222 are connected to a comparator 314. Similarly, solenoid pad distance select switches 228 are connected to a comparator 316 and the solvent run distance select switches 234 are connected to a comparator 318. Finally, the vacuum head distance select switches 240 are connected to a comparator 320. Thus, when the distance set on the various distance select switches matches up with the up-down counter, the comparators provide output signals to distance relays K6, K7, K8, K10 and K9, all as shown in FIG. 16. If the respective function select switches 220, 226, 232 or 244 are in their closed position then the distance relays will provide outputs respectively to the oil solenoid 160, buffer solenoid 200, solvent pad solenoid 83 and vacuum head solenoid 99. When the carriage has traversed the required distance for each operation, the circuit will be broken to the various solenoids to move the apparatus which they operate to a non-functional position or condition. A more complete circuit diagram is shown in FIGS. 17A and 17B. The function of these circuits will be apparent to one skilled in the art. It will be understood that with respect to the embodiment of FIGS. 13–15 that the circuitry will operate motor 304 rather than solvent pad solenoid 83. Otherwise, the circuitry is substantially identical.

From the foregoing, the advantages of this invention are readily apparent. A bowling alley combination lane stripper and dressing apparatus has been provided which is fully automatic and provides for stripping all or a portion of a bowling lane and applying a new dressing. This is a accomplished in one embodiment by bringing an applicator pad bearing cleaner into contact with the lane which dissolves the dressing and suspends any solid particles thereon, the liquid immediately being picked up by a vacuum head which removes the liquid and dirt and drys the lane. Immediately following this operation, a buffer roller applies a layer of dressing to the bowling lane surface. In another embodiment, a pump and motor are activated to pump the solvent through spray nozzles for application to the bowling alley surface. In each embodiment, a distance measuring wheel arrangement is provided that supplies digital signals indicative of the position of the carriage on the bowling alley for sequencing the operation so that the cleaner is dispensed at the appropriate time and shut-off at the right time. In addition, the buffing roller can be brought onto the bowling lane surface as is appropriate after the cleaning procedure is completed.

This invention has been described in detail with reference to particular embodiments thereof, but it will be understood that various other modifications can be effected within the spirit and scope of this invention.

We claim:

1. A combination bowling lane stripper and dressing apparatus comprising:

a carriage for movement along a bowling alley from a foul line to the pit and back again, said carriage having a forward portion and a rearward portion;

a reversible drive mechanism connected to said carriage and having a drive shaft and surface-engaging drive wheels mounted on said drive shaft operative to advance said carriage along a predetermined course in a forward and reverse direction;

cleaner applicator means extending transversely of said carriage in said forward portion and mounted for movement with respect thereto between an operative lane-engaging position and a retracted position within said carriage and above the lane;

a cleaner reservoir;

means for supplying cleaner from said reservoir to said applicator, said cleaner supplying means having a fluid valve for permitting the flow of cleaner to said applicator when open and prohibiting flow of cleaner to said applicator when closed;

a vacuum means for removing cleaner and dirt from the surface of the lane, said vacuum means having a vacuum head extending transversely of said carriage rearwardly of said applicator means and mounted for movement with respect to said carriage between an operative lane-engaging position and a retracted position within said carriage and above the lane;

lane-buffing means including a roller and drive therefore, said roller being journalled for rotation with its surface in lane-contacting relation about a horizontal axis extending transversely of the direction of travel;

lane-dressing means detachably connectable to said lane buffing roller including a reservoir for the storage of a lane-dressing fluid and fluid transfer means, said fluid transfer means being selectively operative to transfer fluid therefrom to said surface of said lane-buffing roller;

power supply means in said carriage;

control means connected to said power supply means responsive to control signals to selectively activate and deactivate each function of said stripper;

an on-off switch which can be closed for activating said drive mechanism so that said carriage travels in a forward direction from the foul lane to the pit;

first means responsive to said control means for opening said fluid valve during at least a portion of said forward travel;

second means responsive to said control means for moving said applicator into said lane-engaging position;

third means responsive to said control means for moving said vacuum head into said lane-engaging position;

fourth means responsive to said control means for causing said fluid transfer means to be operative to transfer dressing fluid from said reservoir to said surface of said lane-buffing roller;

fifth means responsive to said control means to cause said fluid transfer means to become inoperative;

sixth means responsive to said control means for deactivating said first and second responsive means to shut-off said fluid valve and to move said applicator to said retracted position; and a limit switch responsive to said carriage reaching the pit to cause said control means to deactivate said drive mechanism to stop said carriage and to deactivate said third responsive means to raise said vacuum head to said retracted position.

2. Apparatus, as claimed in claim 1, wherein said control means includes:

time delay means:

motor reversing means responsive to said time delay means to activate said drive mechanism in the reverse direction for reverse travel along the lane from the pit to the foul line; and a stop switch for deactivating said drive mechanism when said carriage returns to the foul line.

3. Apparatus, as claimed in claim 2, wherein said control means:

actuates said first responsive means during a portion of said rearward travel; and said stop switch deactivates said first responsive means to cut off flow of cleaner to said applicator when said carriage returns to the foul line.

4. Apparatus, as claimed in claim 1, wherein:

said control means actuates said first, second and third responsive means simultaneously when said on-off switch is closed.

5. Apparatus, as claimed in claim 1, wherein:

said control means actuates said second responsive means and said third responsive means only after said carriage has traveled along the bowling lane a predetermined distance from the foul line to the pit.

6. A combination bowling lane stripper and dressing apparatus comprising:

a carriage for movement along a bowling alley from a foul line to the pit and back again, said carriage having a forward portion and a rearward portion;

a reversible drive mechanism connected to said carriage and having a drive shaft and surface-engaging drive wheels mounted on said drive shaft operative to advance said carriage along a predetermined course in a forward and reverse direction;

cleaner applicator means extending transversely of said carriage in said forward portion;

a cleaner reservoir;

means for supplying cleaner from said reservoir to said applicator, said cleaner supplying means having a fluid valve for permitting the flow of cleaner to said applicator when open and prohibiting flow of cleaner to said applicator when closed;

a vacuum means for removing cleaner and dirt from the surface of the lane, said vacuum means having a vacuum head extending transversely of said carriage rearwardly of said applicator means and mounted for movement with respect to said carriage between an operative lane-engaging position and a retracted position within said carriage and above the lane;

lane-buffing means including a roller and drive therefore, said roller being journalled for rotation with its surface in lane-contacting relation about a horizontal axis extending transversely of the direction of travel;

lane-dressing means detachably connectable to said lane buffing roller including a reservoir for the storage of a lane-dressing fluid and fluid transfer means, said fluid transfer means being selectively operative to transfer fluid therefrom to said surface of said lane-buffing roller;

power supply means in said carriage;

control means connected to said power supply means responsive to control signals to selectively activate and deactivate each function of said stripper;

an on-off switch which can be closed for activating said drive mechanism so that said carriage travels in a forward direction from the foul lane to the pit;

first means responsive to said control means for opening said fluid valve during at least a portion of said forward travel;

second means responsive to said control means for moving said vacuum head into said lane-engaging position;

third means responsive to said control means for causing said fluid transfer means to be operative to transfer dressing fluid from said reservoir to said surface of said lane-buffing roller;

fourth means responsive to said control means to cause said fluid transfer means to become inoperative;

fifth means responsive to said control means for deactivating said first and second responsive means to shut-off said fluid valve; and a limit switch responsive to said carriage reaching the pit to cause said control means to deactivate said drive mechanism to stop said carriage and to deactivate said second responsive means to raise said vacuum head to said retracted position.

7. Apparatus, as claimed in claim 6, wherein said cleaner applicator comprises:

a sprayer device mounted on said forward portion of said carriage for spraying cleaner onto the lane ahead of said carriage; and a motor-driven pump connected between said reservoir and said sprayer device for pumping cleaner under pressure through said sprayer device.

8. Apparatus, as claimed in claim 7, wherein said sprayer device includes:

a pair of sprayer heads mounted on the forward end of said carriage; and a plurality of nozzles attached to each head.

9. Apparatus, as claimed in claim 8, wherein said pressing means includes:

a lateral bar mounted in generally parallel relation to said transfer roller;

a plurality of adjustment screws laterally spaced along said bar, each screw having an end bearing against one of said fingers and being threadably mounted on said bar for adjusting the pressure applied to each finger by each screw.

10. Apparatus, as claimed in claim 6, wherein said fluid transfer means comprises:

a transfer roller in contact with said buffing roller to transfer dressing fluid to said buffing roller;

a wick having a first end in said lane dressing fluid container and a second end positioned to be brought into engagement with said transfer roller and having a width extending substantially the entire length of said transfer roller;

means for selectively pressing said second end of said wick against said transfer roller; and a plurality of fingers along said pressing means selectively biased to apply differing pressures to said wick to selectively control the amount of dressing fluid applied along said transfer roller and said dressing roller to control the amount of dressing applied to each lateral increment of the alley.

11. Apparatus, as claimed in claim 6, wherein said control means includes:

a measuring wheel engageable with the bowling lane and having a circumference equal to a known linear distance so that each revolution of said measuring wheel represents said known linear distance;

indicia spaced equal distances around said circumference of said measuring wheel to identify incremental movement of said measuring wheel; and means sensing the position of said indicia as said wheel rolls along the bowling alley to provide said control signals.

12. Apparatus, as claimed by claim 11, wherein:

said indicia are each an opening through said measuring wheel; and said sensing means includes:

a light source mounted on one side of said measuring wheel and positioned to be aligned with said openings sequentially as said measuring wheel turns to project a light beam therethrough; and means mounted on the other side of said measuring wheel and positioned to sense the light beam sequentially as light pulses when said openings selectively become aligned with said openings to produce said control signals.

* * * * *